US011085180B2

(12) United States Patent
Lin et al.

(10) Patent No.: US 11,085,180 B2
(45) Date of Patent: Aug. 10, 2021

(54) TOILET

(71) Applicant: Zhejiang IKAHE Sanitary Ware Co., Ltd., Zhejiang (CN)

(72) Inventors: Pugen Lin, Taizhou (CN); Zhaoyuan Zeng, Taizhou (CN); Rui Liu, Taizhou (CN); Feng Lin, Taizhou (CN)

(73) Assignee: Zhejiang Ikahe Sanitary Ware Co., Ltd., Taizhou (CN)

( * ) Notice: Subject to any disclaimer, the term of this patent is extended or adjusted under 35 U.S.C. 154(b) by 112 days.

(21) Appl. No.: 16/374,861

(22) Filed: Apr. 4, 2019

(65) Prior Publication Data

US 2019/0242103 A1 Aug. 8, 2019

(30) Foreign Application Priority Data

Feb. 6, 2018 (CN) ..... 201810120246.0

(51) Int. Cl.

| | |
|---|---|
| ***E03D 1/14*** | (2006.01) |
| ***E03C 1/122*** | (2006.01) |
| ***E03D 5/01*** | (2006.01) |
| ***E03C 1/10*** | (2006.01) |
| ***E03C 1/12*** | (2006.01) |
| ***E03D 11/02*** | (2006.01) |
| ***E03D 1/34*** | (2006.01) |
| ***E03D 11/14*** | (2006.01) |

(52) U.S. Cl.

CPC ..... *E03D 1/141* (2013.01); *E03C 1/104* (2013.01); *E03C 1/108* (2013.01); *E03C 1/1222* (2013.01); *E03D 5/01* (2013.01); *E03C 2001/1206* (2013.01); *E03C 2201/60* (2013.01); *E03D 1/144* (2013.01); *E03D 1/34* (2013.01); *E03D 11/02* (2013.01); *E03D 11/14* (2013.01); *E03D 2201/30* (2013.01)

(58) Field of Classification Search

CPC .. E03D 1/141; E03D 5/01; E03D 9/00; E03C 1/104; E03C 1/108; E03C 1/1222

USPC ..... 4/431, 324

See application file for complete search history.

(56) References Cited

U.S. PATENT DOCUMENTS 8,281,424 B2 * 10/2012 Okubo ..... E03D 1/00 4/431

2010/0077544 A1 * 4/2010 Okubo ..... E03D 5/01 4/354

* cited by examiner

*Primary Examiner* — Christine J Skubinna

(74) *Attorney, Agent, or Firm* — MacMillan, Sobanski & Todd, LLC

(57) ABSTRACT

The present disclosure relates to the technical field of toilet equipment, particularly to a toilet. The toilet includes a toilet body, a water tank, an air isolation device, and a water pump, wherein the toilet body is provided thereon with a spout directly facing a sewage exit; the water pump is configured to draw water from the water tank, a water outlet of the water pump is in communication with the spout of the toilet body via the air isolation device, and the air isolation device is configured to block reverse flow of sewage from the spout of the toilet body to the water tank.

11 Claims, 5 Drawing Sheets

TOILET

CROSS-REFERENCE TO RELATED APPLICATIONS

The present disclosure claims the priority to the Chinese patent application with the filing No. CN201810120246.0, filed on Feb. 6, 2018 with the China National Intellectual Property Administration (CNIPA), entitled "Toilet", which is incorporated herein by reference in its entirety.

TECHNICAL FIELD

The present disclosure relates to the technical field of toilet equipment, in particular, to a toilet.

BACKGROUND ART

With the improvement of people's living conditions, many people's homes and even public places are equipped with toilets (closestools) for their convenient use.

At present, toilets are categorized into two types, i.e., toilets with water tank and toilets without water tank, wherein for a toilet with water tank, the toilet is naturally flushed mainly using the gravitational potential energy of water, and in order to achieve a goal of flushing by gravity, a water level in the water tank has to be higher than a siphon spout of a toilet bowl; a toilet without water tank is connected with natural water pipelines, thereby flushing by pressure is performed by utilizing a water pressure of the natural water via control of a flush valve, which depends on the water pressure of natural water supply to a great extent, the flushing cannot be accomplished when the water pressure is low, with relatively large noise and an unstable water volume for flushing.

In view of the above, how to overcome the above defects of the existing toilets is a technical problem to be solved urgently by those skilled in the art.

SUMMARY

Embodiments of the present disclosure provide a toilet, including a toilet body, a water tank, an air isolation device, and a water pump.

In the above, the toilet body is provided thereon with a spout directly facing a sewage exit; the water pump is configured to draw water from the water tank, and a water outlet of the water pump is in communication with the spout of the toilet body via the air isolation device, and the air isolation device is configured to block reverse flow of sewage from the spout of the toilet body to the water tank.

BRIEF DESCRIPTION OF DRAWINGS

In order to more clearly illustrate technical solutions in specific embodiments of the present disclosure or in the prior art, accompanying drawings which are needed to be used for description of the specific embodiments or the prior art will be introduced briefly below. It is apparent that the accompanying drawings below merely show some embodiments of the present disclosure, and a person ordinarily skilled in the art can still obtain other accompanying drawings according to these accompanying drawings without any creative effort.

Reference signs: 10—toilet body; 11—spout; 12—flushing tube; 20—water tank; 21—flow guide; 30—air isolation device; 31—spring; 32—baffle; 33—stop block; 40—water pump; 50—first water discharge tube; 51—first tube portion; 52—second tube portion; 53—connection tube portion; 60—second water discharge tube; 70—third water discharge tube; 80—distributing valve; 90—water inlet assembly.

DETAILED DESCRIPTION OF EMBODIMENTS

The technical solutions of the present disclosure will be described below clearly and completely in combination with the accompanying drawings, apparently, the embodiments described are merely a part of, rather than all of the embodiments of the present disclosure. Based on the embodiments of the present disclosure, all the other embodiments, obtained by a person ordinarily skilled in the art without using creative effort, shall fall within the scope of protection of the present disclosure.

In the description of the present disclosure, it should be noted that orientational or positional relations indicated by terms such as "upper", "lower", "inner" and "outer" are based on orientational or positional relations as shown in the accompanying drawings, merely for facilitating describing the present disclosure and simplifying the description, rather than indicating or implying that referred devices or elements have to be in the specific orientation or to be constructed and operated in specific the orientation, therefore, they should not be construed as limitation on the present disclosure. Besides, terms such as "first", "second", and "third" are merely for descriptive purpose, but should not be construed as indicating or implying relative importance.

In the description of the present disclosure, it should be noted that unless otherwise specified and defined explicitly, terms "mount", "connect", and "join" should be construed in a broad sense. For example, the connection can be fixed connection, detachable connection, or integrated connection; it can be mechanical connection or electrical connection; it can be direct connection or indirect connection via an intermediate medium; and it can also be an inner communication between two elements. For a person ordinarily skilled in the art, specific meanings of the above mentioned terms in the present disclosure can be understood according to specific circumstances.

In the following, the present disclosure is described further in detail with the detailed embodiments and in connection with the accompanying drawings.

Embodiment 1

Figure 1:
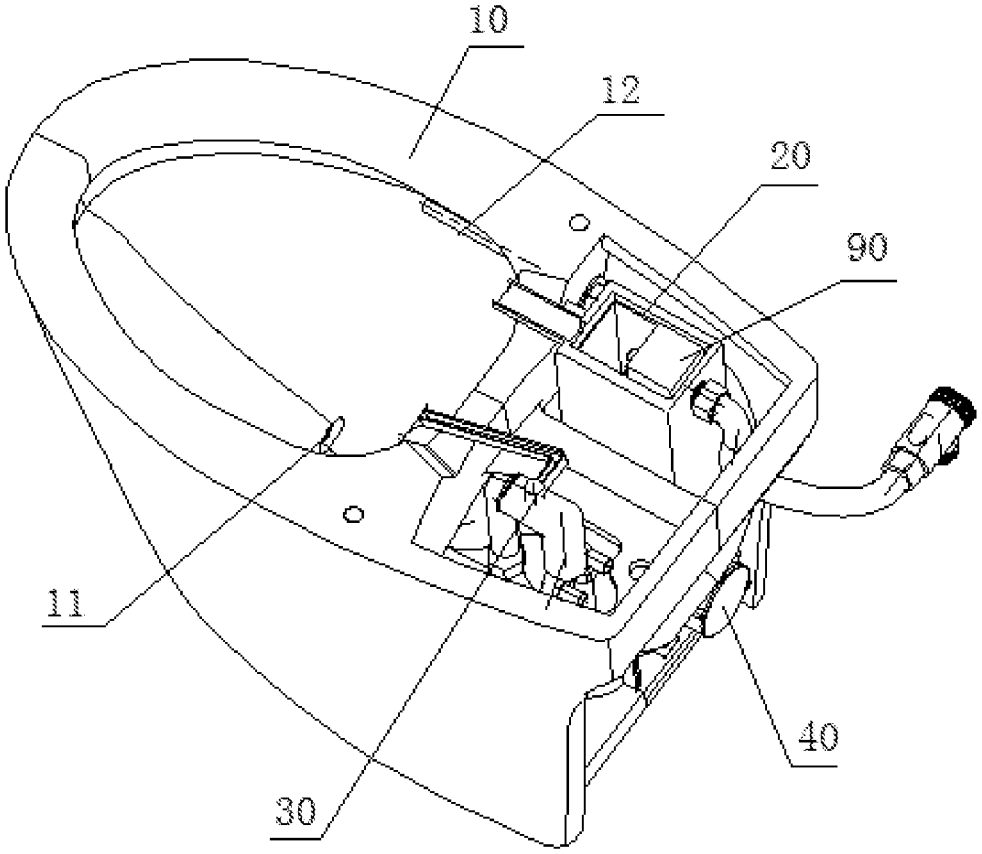
FIG. 1 is a three-dimensional structural schematic diagram of a toilet provided in an embodiment of the present disclosure.

Referring to FIG. 1, the present Embodiment 1 provides a toilet, including a toilet body 10, a water tank 20, an air isolation device 30, and a water pump 40.

In the above, the toilet body 10 is provided thereon with a spout 11 directly facing a sewage exit; the water pump 40 is configured to draw water from the water tank 20, and a water outlet of the water pump 40 is in communication with the spout 11 of the toilet body 10 via the air isolation device 30, and the air isolation device 30 is configured to block reverse flow of sewage from the spout 11 of the toilet body towards the water tank 20.

From analysis on specific connection modes and positional relations among the structures described above, it can be known that: since the water pump 40 can draw water from the water tank 20 and allow the water to be ejected at a certain flow rate from the spout 11, flushing of the toilet bowl can be achieved regardless whether a water level of the water in the water tank 20 is higher than the spout 11, that is, a position of the water tank 20 can be set at will as needed, and a volume of the water tank 20 further can be enlarged by utilizing spare places at the bottom of the toilet; moreover, such arrangement does not involve the problem of dependency on a water pressure of water supply, either.

It is to be noted that, the air isolation device 30 is provided between the water outlet of the water pump 40 and the spout 11 of the toilet body, thereby the siphon which occurs when the water exit of the water tank 20 is lower than a water surface in the toilet bowl and which causes the problem that the sewage in the toilet bowl flows reversely into the water tank 20 from the spout 11 can be avoided, thus the cleanliness of water storage in the water tank 20 is ensured, which avoids the occurrence of moldy and smelly status in the water tank 20 caused by pollution of the water tank 20 resulted from the sewage, reducing the frequency at which a user cleans the water tank 20.

Therefore, the toilet provided in the present Embodiment 1 produces much less noise than a toilet without water tank, the position of the water tank 20 can be set at will while the spare spaces further can be utilized, the toilet is not affected by the water pressure of water supply or a volume of water replenishment, has a constant water volume for flushing, and also has a characteristic of anti-reverse-flow.

Embodiment 2

Referring to FIG. 1, the present Embodiment 2 provides a toilet, which also adopts technical structure relations of the toilet in the above Embodiment 1, for example, the present Embodiment 2 provides a toilet, including a toilet body 10, a water tank 20, an air isolation device 30, and a water pump 40, wherein the toilet body 10 is provided thereon with a spout 11 directly facing a sewage exit; the water pump 40 is configured to draw water from the water tank 20, and a water outlet of the water pump 40 is in communication with the spout 11 of the toilet body 10 via the air isolation device 30, and the air isolation device 30 is configured to block reverse flow of sewage from the spout 11 of the toilet body towards the water tank 20.

Main structures of the toilet provided in the present Embodiment 2 are identical to those of the toilet in Embodiment 1; however, the toilet provided in the present Embodiment 2 further involves specific structural designs. The present Embodiment 2 differs from the above Embodiment 1 in that: the specific structures of the toilet in the present Embodiment 2 have more specific structural characteristics, for example, some technical features are added, and specific structures of the air isolation device 30 are further defined.

The specific structures and technical effects relating to the technical solution of the present Embodiment 2 are as follows:

Among the specific structures, for a position of the water pump, there are at least two implementable modes as follows:

In a first implementable mode, a water exit can be provided on the water tank, and the water exit on the water tank is in communication with the water inlet of the water pump. In the existing toilet, since a fixed sealing element is present between a drainage assembly and a bottom of the water tank, after each time of flushing, water having a height of about 10-20 mm is left at the bottom of the water tank, thus the water in the water tank cannot be adequately utilized, which wastes the volume of the water tank to a high degree. In the toilet provided in the present Embodiment 2, the water exit on the water tank 20 can be provided at the bottom of the water tank 20, which effectively solves the problem of volume wasting of the water tank 20.

In a second implementable mode, the water pump can be disposed within the water tank to directly draw water from the water tank and transport the water to the spout of the toilet body.

Figure 2:
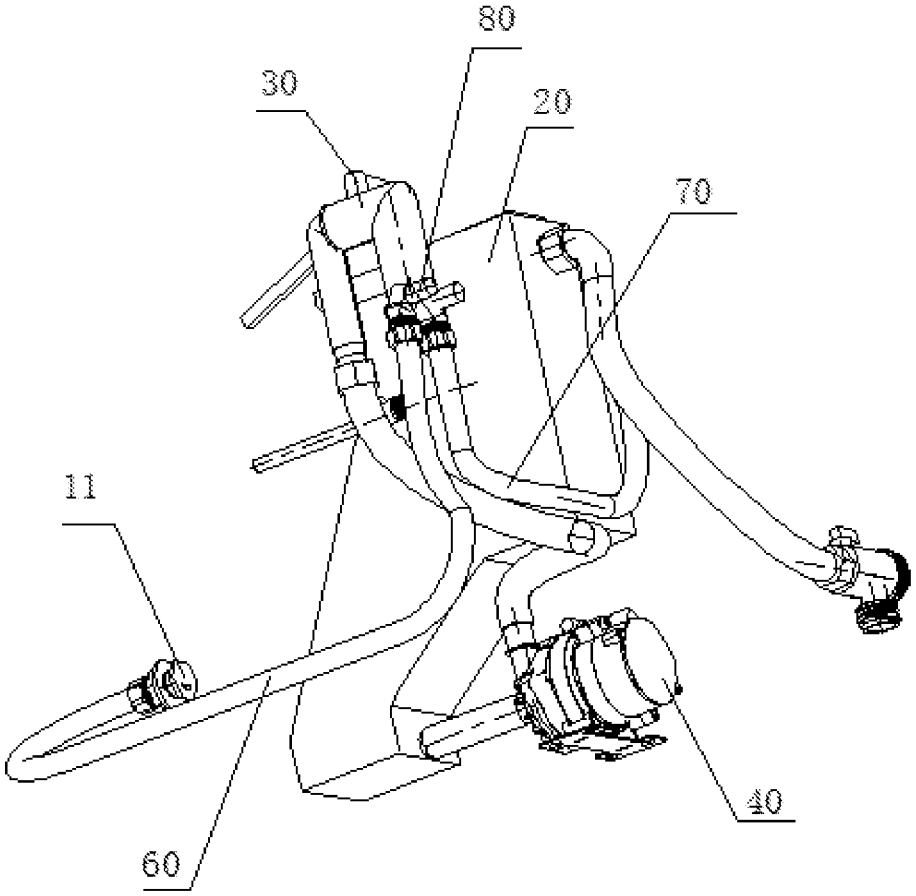
FIG. 2 is structural schematic diagram illustrating connections among internal pipelines of a toilet provided in an embodiment of the present disclosure.
Figure 3:
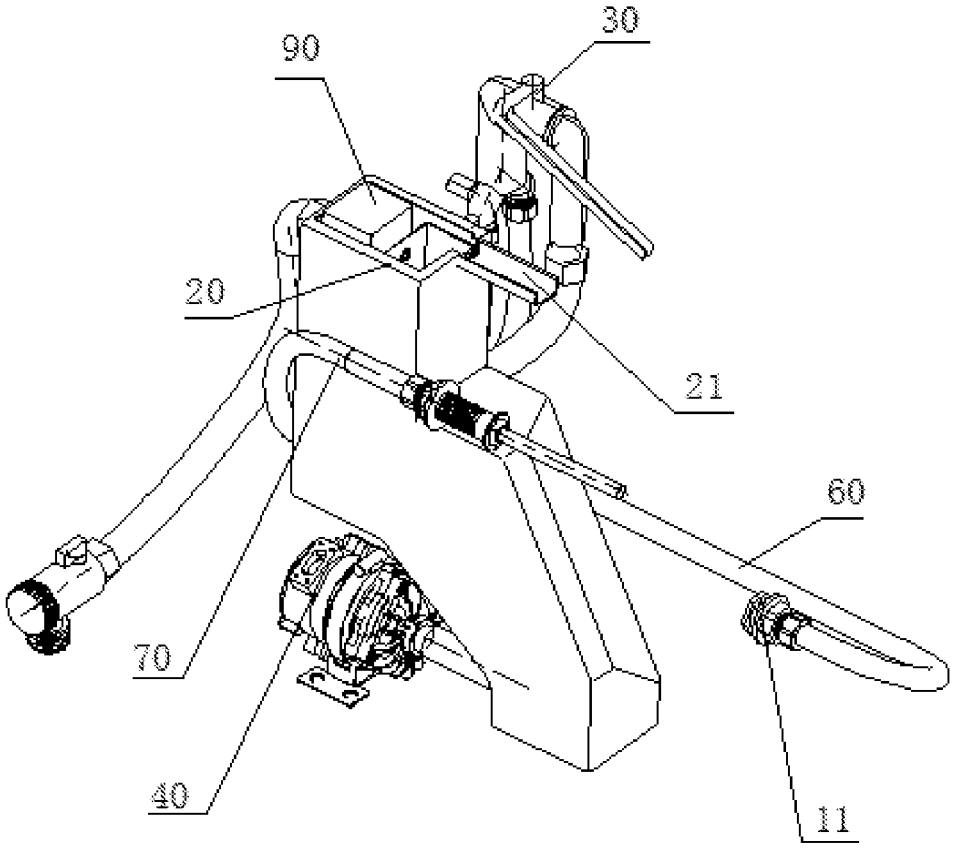
FIG. 3 is structural schematic diagram illustrating, from another perspective, connections among internal pipelines of a toilet provided in an embodiment of the present disclosure.
Figure 4:
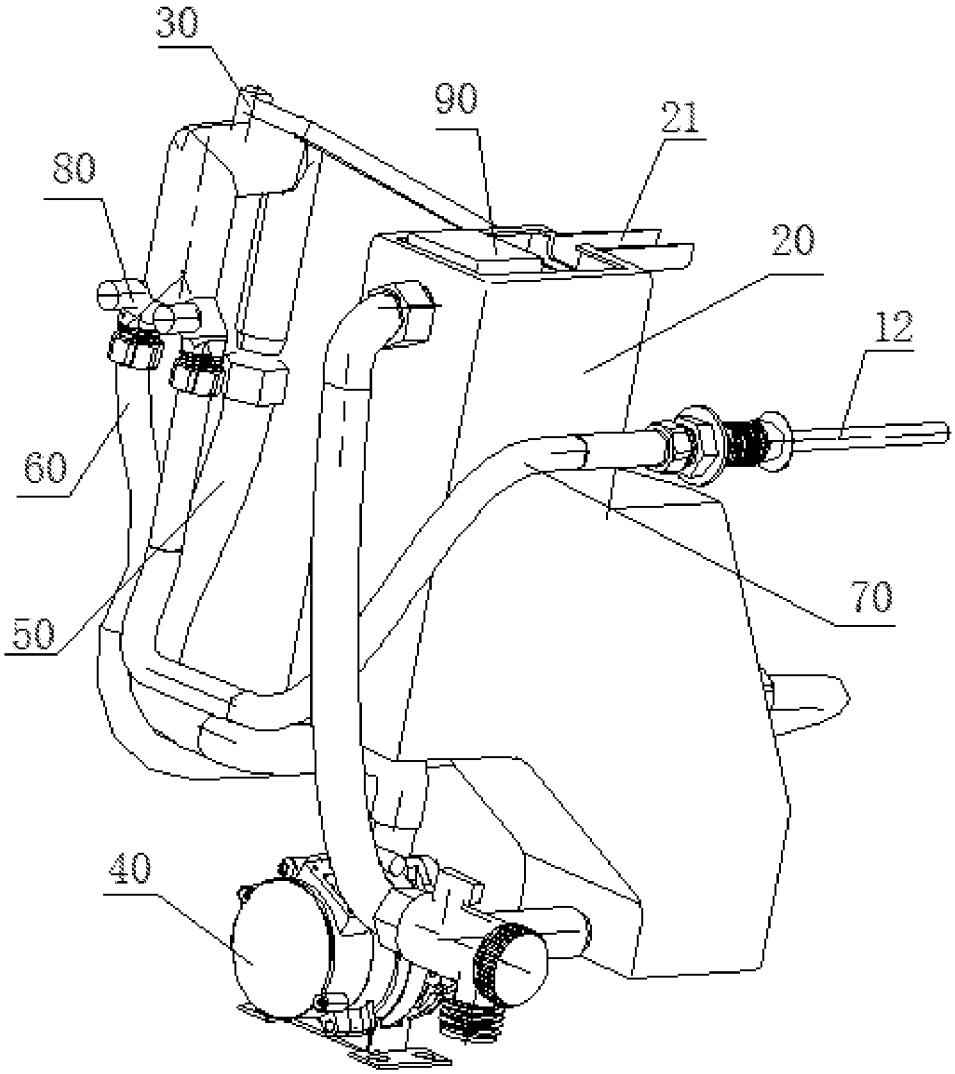
FIG. 4 is structural schematic diagram illustrating, from still another perspective, connections among internal pipelines of a toilet provided in an embodiment of the present disclosure.

Among the specific structures, for a position of a distributing valve, there are at least two implementable modes as follows:

In a first implementable mode, referring to FIG. 2 to FIG. 4, the toilet body 10 may be provided thereon with a flushing port for flushing an inner wall of the toilet bowl, meanwhile, in order to enable the water supplied from the water pump 40 to be ejected as needed from the spout 11 or the flushing port of the toilet body 10, a first water discharge tube 50 connected with the water outlet of the water pump 40, and a second water discharge tube 60 and a third water discharge tube 70 respectively connected with the spout 11 and the flushing port of the toilet body 10 are provided. A water outlet end of the first water discharge tube 50 communicates with water inlet ends of the second water discharge tube 60 and the third water discharge tube 70 respectively. Meanwhile, a distributing valve 80 is provided at an end portion of the first water discharge tube 50, such that it can be selected that the first water discharge tube 50 is in communication with the second water discharge tube 60 or the third water discharge tube 70 by means of the distributing valve 80, furthermore, it can be selected that the water is output from the spout 11 or the flushing port, so as to meet the needs of flushing from the user and to further economize water resource (for example, it is feasible to first control the distributing valve 80 to enable communication of the first water discharge tube 50 and the third water discharge tube 70, to flush the inner wall of the toilet bowl for 5 s with water ejected from the flushing port, then, control the distributing valve 80 to enable communication of the first water discharge tube and the second water discharge tube 60 to eject water from the spout 11 and siphonate for 3 s, and finally control the distributing valve 80 to enable communication of the first water discharge tube 50 and the third water discharge tube 70 to flush the inner wall of the toilet bowl for 4 s with the water ejected from the flushing port, thereby completing a flushing operation of the toilet).

In a second implementable mode, an upper portion of the toilet body is provided with a flushing port for flushing the inner wall, the toilet body is provided therein with a distributing structure, a water outlet of the distributing structure is respectively in communication with the spout and the flushing port, and a water inlet of the distributing structure is in communication with the water outlet of the water pump via the first water discharge tube; that is to say, for the toilet body having the distributing structure in itself, it is not necessary to add a distributing valve, but it simply needs to connect the first water discharge tube with the water inlet of the distributing structure of the toilet body, then the distributing structure will distribute by itself the water flow to the spout and the flushing port.

In order to enable the air isolation device 30 to achieve the effect of preventing the sewage in the toilet bowl from flowing reversely into the water tank 20 from the spout 11 or the flushing port, the air isolation device 30 is provided on the first water discharge tube 50.

Figure 5:
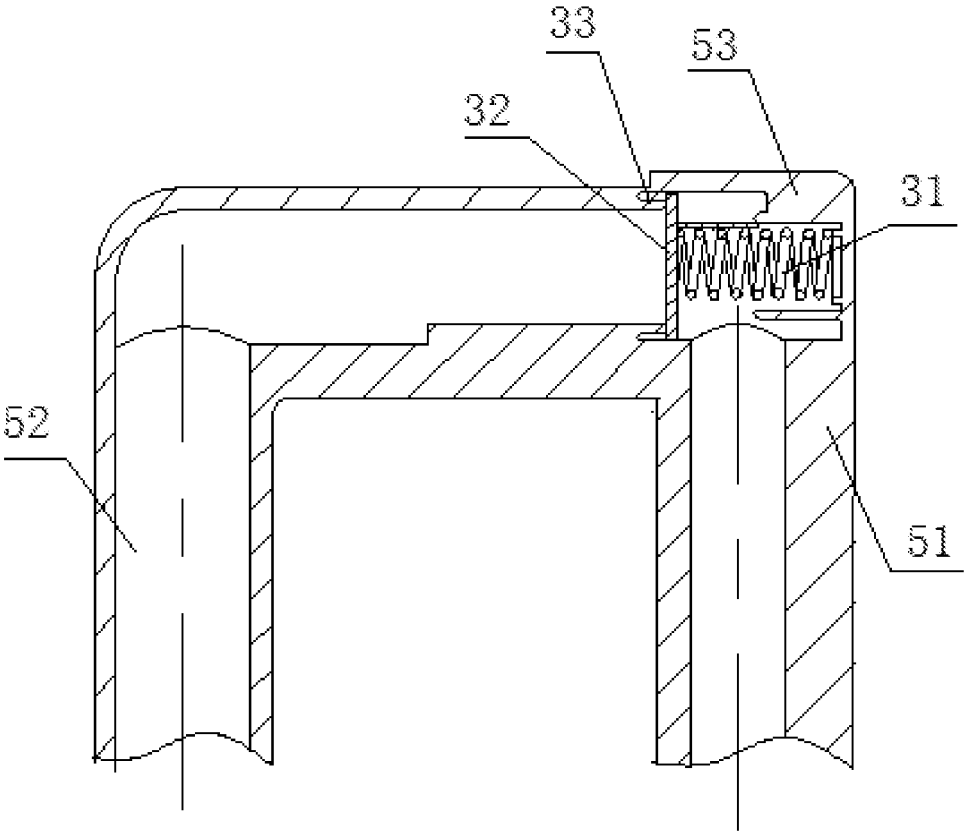
FIG. 5 is a schematic diagram illustrating an assembled structure of an air isolation device and a first water discharge tube in a toilet provided in an embodiment of the present disclosure.

In an implementable mode, referring to FIG. 5, the air isolation device 30 includes an elastic structural element, a baffle 32, and a stop block 33, meanwhile, in order to be adapted to the structure of such air isolation device 30, the first water discharge tube 50 is divided into a first tube portion 51 on which the distributing valve 80 is mounted, a second tube portion 52 in communication with the water outlet of the water pump 40, and a connection tube portion 53 connected between the first tube portion 51 and the second tube portion 52; the elastic structural element has one end connected with an outer tube wall of the connection tube portion 53 close to the first tube portion 51, and the other end elastic structural element connected with the baffle 32, to enable the baffle 32 to move in an extension direction of the second tube portion 52 under the action of the elastic structural element. The second tube portion 52 is provided thereon with the stop block 33 for restraining the movement of the baffle 32, such that the baffle 32 can abut against the stop block 33 under the thrust effect of the elastic structural element, so as to serve a function of fixing the position, and to be capable of cutting off a communication channel between the first tube portion 51 and the second tube portion 52.

When the water pump 40 supplies water, the water pressure pushes the baffle 32 to compress the elastic structural element, such that the water flow can smoothly enter the second water discharge tube 60 and the third water discharge tube 70, and when the water pump 40 stops supplying water, the baffle 32 restores its initial position under the pressure from the elastic structural element, at this moment, the baffle 32 cuts off the communication between the first tube portion 51 and the second tube portion 52, to prevent the sewage from flowing reversely into the water tank 20 from the spout 11 or the flushing port.

Preferably, a spring 31 with a low cost may be selected as the elastic structural element.

In particular, in order to be adapted to the shape of the inner wall of the toilet bowl, it is feasible to connect a flushing tube 12 at the flushing port of the toilet body 10.

In order to avoid excessive water in the water tank 20 from overflowing onto the ground, a flow guide 21 is provided in a top portion of the water tank 20, and the flow guide 21 extends from the water tank 20 to right above the toilet bowl of the toilet body 10, such that the water overflowing from the water tank 20 can flow into the toilet bowl of the toilet body 10 along the flow guide 21.

In a specific structure, the height of the flow guide 21 may be set as higher than an overflow plane of the toilet body 10 by 25 mm or more.

Preferably, referring to FIG. 3, the water tank 20 may be provided thereon with a water inlet assembly 90, and the water tank 20 may be connected with an external water source via the water intake assembly 90, so as to control the external water source to supply water into the water tank 20 or stop the water supply by means of the water inlet assembly 90.

Furthermore, it is feasible to set the height of the air isolation device 30 to be higher than the flushing port on the toilet body 10, such that the sewage cannot flow to the position of the air isolation device 30, thereby preventing the sewage from damaging the air isolation device 30, and prolonging service life of the air isolation device 30.

In conclusion, the embodiments of the present disclosure provide a toilet, which overcomes various technical defects of conventional toilets. For the toilet provided in the embodiments of the present disclosure, the noise is much less than that of the toilet without water tank, the position of the water tank can be set at will while the spare space can be utilized, and the toilet is not affected by the water pressure of water supply or the volume of water replenishment, has a constant water volume for flushing, and also has a characteristic of anti-reverse-flow.

It is to be noted in the end that: the above examples are merely for describing the technical solution of the present disclosure rather than limiting the same; although the present disclosure is described in detail in reference with the foregoing embodiments, a person ordinarily skilled in the art should understand that: amendments can still be made to the technical solutions described in the foregoing embodiments, or equivalent substitutions can be made to some or all of the technical features therein; while these amendments or substitutions do not make the essence of corresponding technical solutions depart from the scope of the technical solutions of the embodiments of the present disclosure.

The invention claimed is:

1. A toilet, comprising a toilet body, a water tank, an air isolation device, and a water pump, wherein the toilet body is provided thereon with a spout which directly faces a sewage exit;

the water pump is configured to draw water from the water tank, and a water outlet of the water pump is in communication with the spout on the toilet body via the air isolation device, and the air isolation device is configured to block reverse flow of sewage from the spout of the toilet body to the water tank; and further comprising a first water discharge tube, a second water discharge tube, a third water discharge tube, and a distributing valve, wherein an upper portion of the toilet body is further provided with a flushing port for flushing an inner wall;

the first water discharge tube has a water inlet end connected with the water outlet of the water pump, and a water outlet end communicating with a water inlet end of the second water discharge tube and a water inlet end of the third water discharge tube respectively, a water outlet end of the second water discharge tube is connected with the spout, and a water outlet end of the third water discharge tube is connected with the flushing port; and the air isolation device is provided on the first water discharge tube, the distributing valve is provided at an end portion of the first water discharge tube, and the distributing valve is configured to switch between water paths of water in the first water discharge tube flowing to the second water discharge tube and flowing to the third water discharge tube.

2. The toilet according to claim 1, wherein a water exit is provided at a bottom of the water tank, and the water exit on the water tank is in communication with a water inlet of the water pump.

3. The toilet according to claim 1, wherein the air isolation device comprises an elastic structural element, a baffle, and a stop block;

the first water discharge tube comprises a first tube portion, a second tube portion, and a connection tube portion, wherein the connection tube portion is an arc-shape tube, the first tube portion and the second tube portion are respectively located at two sides of the connection tube portion, the distributing valve is located on the first tube portion, and the second tube portion is in communication with the water outlet of the water pump;

the elastic structural element has one end connected with an outer tube wall of the connection tube portion close to the first tube portion, and the other end connected with the baffle; and the baffle is configured to be movable in an extension direction of the second tube portion, the stop block is located on the second tube portion and is configured to restrain movement of the baffle, wherein a water path between the first tube portion and the second tube portion is able to be cut off when the baffle is attached to the stop block.

4. The toilet according to claim 1, wherein a flushing tube is further connected at the flushing port of the toilet body.

5. The toilet according to claim 1, wherein a flow guide is provided in a top portion of the water tank, and the flow guide extends from the water tank to right above a toilet bowl of the toilet body, and water overflowing from the water tank is capable of flowing into the toilet bowl of the toilet body along the flow guide.

6. The toilet according to claim 5, wherein the flow guide is 25 mm or more higher than an overflow plane of the toilet body.

7. The toilet according to claim 1, wherein the water tank is further provided thereon with a water inlet assembly, and the water tank is connected with an external water source via the water intake assembly.

8. The toilet according to claim 2, wherein a flow guide is provided in a top portion of the water tank, and the flow guide extends from the water tank to right above a toilet bowl of the toilet body, and water overflowing from the water tank is capable of flowing into the toilet bowl of the toilet body along the flow guide.

9. The toilet according to claim 1, wherein a flow guide is provided in a top portion of the water tank, and the flow guide extends from the water tank to right above a toilet bowl of the toilet body, and water overflowing from the water tank is capable of flowing into the toilet bowl of the toilet body along the flow guide.

10. The toilet according to claim 2, wherein the water tank is further provided thereon with a water inlet assembly, and the water tank is connected with an external water source via the water intake assembly.

11. The toilet according to claim 1, wherein the water tank is further provided thereon with a water inlet assembly, and the water tank is connected with an external water source via the water intake assembly.

* * * * *